US010941622B2

(12) United States Patent
Lambert et al.

(10) Patent No.: US 10,941,622 B2
(45) Date of Patent: Mar. 9, 2021

(54) SYSTEM AND METHODOLOGY UTILIZING CONDUCTOR SHARING OFFSET SHOE

(71) Applicant: Cameron International Corporation, Houston, TX (US)

(72) Inventors: Anthony Lambert, St. John's (CA); Adam Baker, St. John's (CA); Michael J. O'Keefe, St. John's (CA); Dwayne C. Raynard, St. John's (CA)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 0 days.

(21) Appl. No.: 16/255,383

(22) Filed: Jan. 23, 2019

(65) Prior Publication Data

US 2020/0232289 A1 Jul. 23, 2020

(51) Int. Cl.

| | |
|---|---|
| ***E21B 19/24*** | (2006.01) |
| ***E21B 7/00*** | (2006.01) |
| ***E21B 33/047*** | (2006.01) |
| ***E21B 17/10*** | (2006.01) |

(52) U.S. Cl.

CPC ..... *E21B 19/24* (2013.01); *E21B 7/00* (2013.01); *E21B 17/1035* (2013.01); *E21B 33/047* (2013.01)

(58) Field of Classification Search

CPC ..... E21B 33/047; E21B 17/1035; E21B 7/00; E21B 19/24

See application file for complete search history.

(56) References Cited

U.S. PATENT DOCUMENTS

| | | | | |
|---|---|---|---|---|
| 4,175,619 A | | 11/1979 | Davis | |
| 4,573,541 A | * | 3/1986 | Josse | E21B 43/14 175/78 |
| 5,560,435 A | * | 10/1996 | Sharp | E21B 7/043 175/5 |
| 5,685,373 A | * | 11/1997 | Collins | E21B 7/043 166/313 |

(Continued)

FOREIGN PATENT DOCUMENTS

WO 9964713 A1 12/1999

OTHER PUBLICATIONS

International Search Report and Written Opinion issued in PCT/US2020/014375, dated Jun. 5, 2020 (13 pages).
Conductor Sharing Wellhead System, Aug. 2011 (49 pages).

*Primary Examiner* — Nicole Coy
(74) *Attorney, Agent, or Firm* — Michael L. Flynn

(57) ABSTRACT

A technique facilitates drilling operations by combining a conductor with a conductor sharing offset shoe system. The conductor sharing offset shoe system protects against collision of boreholes by properly positioning and/or orienting a drill string during drilling of boreholes through the conductor. The conductor sharing offset shoe system may comprise a bullnose disposed at a lower end of the shoe system and an upper guide member disposed at an upper end of the shoe system with a guide opening sized to receive the drill string therethrough. A guide tubing extends from the guide opening into the bullnose to guide the drill string during drilling of a borehole. The guide tubing is sized to preserve sufficient space for accommodating movement of the drill string through the conductor sharing offset shoe system externally of the guide tubing during drilling of another borehole.

20 Claims, 4 Drawing Sheets

(56) References Cited

U.S. PATENT DOCUMENTS

| | | | | | |
|---|---|---|---|---|---|
| 6,142,235 | A * | 11/2000 | Monjure | E21B 7/043 | 166/313 |
| RE38,642 | E * | 11/2004 | Gondouin | E21B 7/061 | 166/117.6 |
| 7,013,988 | B2 * | 3/2006 | Westmeyer | E21B 7/00 | 175/19 |
| 7,066,267 | B2 * | 6/2006 | Hall | E21B 7/061 | 166/313 |
| 7,264,067 | B2 * | 9/2007 | Glaser | E21B 7/061 | 166/313 |
| 9,670,733 | B1 * | 6/2017 | Ng | E21B 7/12 | |
| 2008/0121396 | A1 | 5/2008 | Hebert et al. | | |
| 2015/0308195 | A1 | 10/2015 | Mitchell | | |
| 2019/0085645 | A1 * | 3/2019 | Strand | E21B 7/205 | |

* cited by examiner

SYSTEM AND METHODOLOGY UTILIZING CONDUCTOR SHARING OFFSET SHOE

BACKGROUND

Hydrocarbon fluids such as oil and natural gas are obtained from a subterranean geologic formation, referred to as a reservoir, by drilling a well that penetrates the hydrocarbon-bearing geologic formation. In many applications, a large diameter pipe called a conductor is set to reinforce a first relatively shallow borehole. For example, the conductor may be a short string of large diameter casing set to support the surface formations. Generally, the conductor is set soon after drilling has commenced to prevent washout or cave in of the shallow formations. The conductor effectively supports the surrounding formation and provides other benefits, e.g. protecting the water table, before drilling deeper boreholes into the formation. To conserve space and costs, multiple wellbores may be drilled through one conductor. However, existing systems are limited in their ability to position the drill string (and subsequent permanent casing strings) so as to avoid collision of the wellbores during drilling operations.

SUMMARY

In general, a system and methodology facilitate drilling operations including subsea drilling operations in which boreholes are drilled in close proximity to each other. According to an embodiment, the technique utilizes a conductor combined with a conductor sharing offset shoe system. The conductor sharing offset shoe system protects against collision of boreholes by properly positioning and/or orienting the drill string during drilling of boreholes through the conductor. The conductor sharing offset shoe system may comprise a bullnose disposed at a lower end of the shoe system and an upper guide member disposed at an upper end of the shoe system with a guide opening sized to receive the drill string therethrough. A guide tubing extends from the guide opening into the bullnose to guide the drill string during drilling of a borehole. The guide tubing is sized to preserve sufficient space for accommodating movement of the drill string through the conductor sharing offset shoe system externally of the guide tubing during drilling of another borehole.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
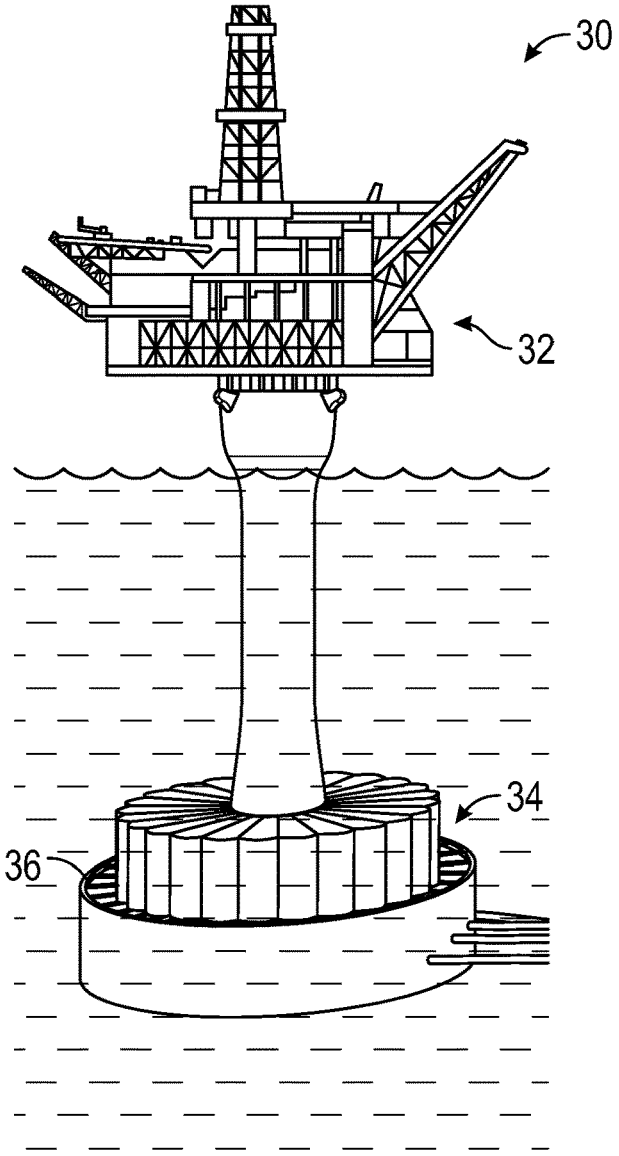
FIG. 1 is an illustration of an example of an offshore drilling and production platform used for drilling, completing and producing wells offshore, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which facilitate drilling operations in which boreholes, e.g. wellbores, are drilled in close proximity to each other. The system and methodology may be used in subsea or surface drilling operations in which boreholes, e.g. pairs of boreholes, are drilled in close proximity to each other. The technique enables positioning and/or orientation of pairs of boreholes which are drilled in regions having many additional wellbores also located in close proximity.

According to an embodiment, the technique utilizes a conductor combined with a conductor sharing offset shoe system. The conductor sharing offset shoe system protects against collision of boreholes by properly positioning and/or orienting a drill string during drilling of boreholes through the conductor. The conductor sharing offset shoe system may comprise a bullnose disposed at a lower end of the shoe system and an upper guide member disposed at an upper end of the shoe system. The upper guide member includes a guide opening sized to receive the drill string therethrough. In some embodiments, the bullnose and the upper guide member may be formed of drillable material, such as drillable cement or composite material.

A guide tubing extends along the interior of a shoe system tubing from the guide opening into the bullnose to guide the drill string during drilling of a borehole. The guide tubing is sized to preserve sufficient space for accommodating and guiding movement of the drill string through the shoe system tubing externally of the guide tubing during drilling of another borehole. In some embodiments, a second guide tubing could be used for drilling of the subsequent borehole, although the subsequent borehole may simply be drilled by utilizing the space between the guide tubing and the shoe system tubing. The conductor sharing offset shoe system also is constructed to facilitate cementing operations, e.g. cementing of the conductor in a conductor cavity and cementing of casing deployed along the boreholes.

In some embodiments, the conductor and the conductor sharing offset shoe system may be combined and run in as part of a casing string. During this run in of the conductor with the offset shoe system, a desired orientation may be maintained via, for example, a vertical scribe line. The conductor sharing offset shoe system is constructed to control positioning of a drill string through an interior of the conductor so as to force drilling of a first side/borehole in a correct position. The conductor sharing offset shoe system subsequently allows the drill string to find its way through weak material (or a corresponding opening) during drilling of a second side/borehole by moving the drill string through an interior of the conductor. In some applications, a "smart" drill string may be employed, and this approach potentially enables initially drilling either side/borehole.

Depending on the parameters of a given drilling operation, the conductor and conductor sharing offset shoe system may be used to maintain positive separation of boreholes during drilling. The offset shoe system may be preinstalled/affixed to the conductor and may utilize a separation device, e.g. bullnose and guide tubing, located at the bottom of the conductor. Drilling operations can be performed without a smart drill string or dummy drill string although such drill strings may be employed. The conductor sharing offset shoe system may utilize an upper guide member having a drillable shoulder and space for fluid bypass if desired.

Referring generally to FIG. 1, an example of an offshore well system 30 is illustrated. Although many types of subsea drilling systems and techniques may be used, one example is fixed platform offshore drilling. In this type of system, basic components include a surface facility 32, e.g. a surface rig, which is installed on top of a subsea installation 34 which may include, for example, a tower, gravity base, and jacket which sit on a seafloor/formation 36. However, the illustrated embodiment is provided simply as an example and various other types of drilling systems may be used to perform the desired operations.

Figure 2:
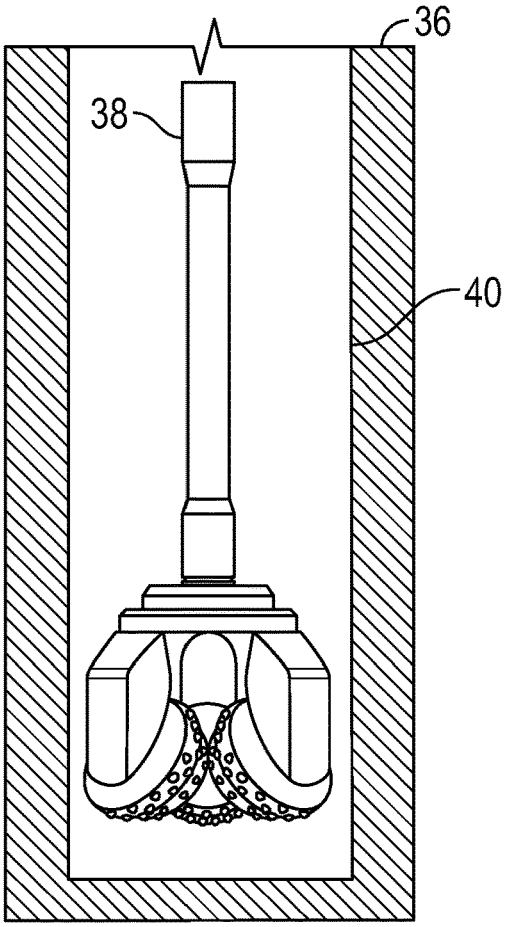
FIG. 2 is an illustration of an example of a conductor cavity being drilled, according to an embodiment of the disclosure.

With additional reference to FIG. 2, the surface facility 32 enables a variety of drilling operations and other operations, e.g. production operations. For example, an initial drill string 38 may be used to drill a relatively large cavity 40, e.g. conductor cavity, into the seafloor/formation 36. It should be noted that other techniques may be used to form the cavity 40.

Figure 3:
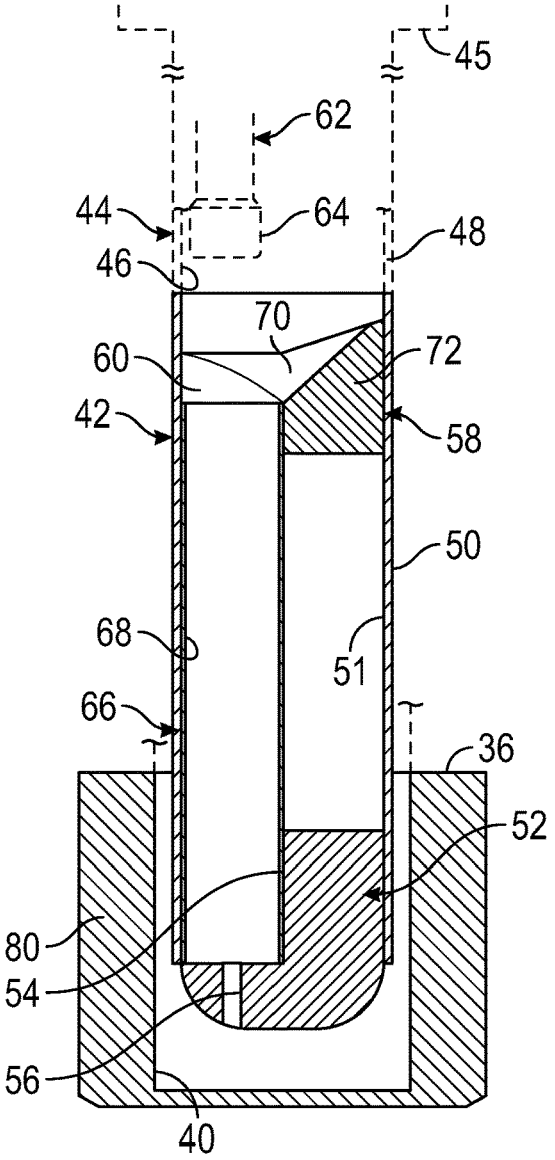
FIG. 3 is an illustration of an example of a conductor sharing offset shoe system coupled with a conductor, according to an embodiment of the disclosure.

Referring generally to FIG. 3, conductor sharing offset shoe (CSOS) 42 is illustrated as deployed in the cavity 40 beneath a conductor 44. (A wellhead 45 may be installed after the conductor 44 is set, but generally there are no wellhead components installed when the conductor borehole/cavity 40 is drilled.) The conductor 44 has an interior conductor passage 46 and is connected to the CSOS 42. For example, the CSOS 42 may be affixed to a leading end of the conductor 44 as it is run into the borehole/cavity 40. The conductor 44 may extend from the CSOS 42 back up to the surface facility 32 during installation. By way of example, the conductor 44 may be in the form of a relatively large tubular structure defined by a tubing wall 48 which may have the same outer diameter as a shoe system tubing or outer housing 50 of the CSOS 42. Depending on the application, the conductor 44 may have an outer diameter of 16-40 inches, e.g. 36 inches, although other sizes may be used to accommodate the parameters of a given application.

The conductor sharing offset shoe system 42 may comprise a bullnose 52 disposed within an interior passage 51 of outer housing 50 at a lower end of the CSOS 42. The bullnose 52 may be formed within the outer housing 50 or otherwise secured along the interior surface of outer housing 50 via adhering material, interference fit, or other suitable techniques. The bullnose 52 may be formed of cement, composite, or other suitable drillable material. In the embodiment illustrated, the bullnose 52 includes a larger cylindrical opening 54 in communication with a smaller passage 56 which may be used to facilitate cementing of the CSOS 42 in conductor cavity 40.

The conductor sharing offset shoe system 42 also comprises an upper guide member 58 disposed above the bullnose 52, e.g. at an upper end of the CSOS 42 or other suitable location. Depending on the application, the upper guide member 58 may be disposed at some distance, e.g. 9-40 feet, above the bullnose 52. The upper guide member 58 may include a guide opening 60 sized to receive a drill string 62 (having a drill bit 64) therethrough during a drilling operation. A guide tubing 66 may be positioned to extend from the guide opening 60 of upper guide member 58 down into the large cylindrical opening 54 formed in bullnose 52.

The guide tubing 66 may be formed of metal or other suitably hard material and may include an internal tubing passage 68. The internal tubing passage 68 is sized to receive the drill bit 64 and drill string 62 therethrough during the drilling operation. Additionally, the external diameter of guide tubing 66 is selected to preserve sufficient space between the interior surface of outer housing 50 and the exterior of guide tubing 66 to accommodate movement of the drill string 62 through the outer housing 50 externally of the guide tubing 66 during drilling of a subsequent borehole. The exterior of guide tubing 66 and the interior surface of outer housing 50 provide the desired guidance of drill string 62. In some embodiments, the space between guide tubing 66 and outer housing 50 also may be used for a fluid bypass.

The upper guide member 58 also may include a sloped surface 70 which is oriented to guide the drill bit 64 into the guide opening 60 and thus into internal tubing passage 68. During drilling of a first borehole, for example, the drill bit 64 may be non-rotating as it is moved down into engagement with the upper guide member 58. The sloped surface 70 is able to guide the drill bit 64 and drill string 62 into the guide opening 60 and thus into tubing passage 68.

In the example illustrated, the upper guide member 58 also comprises a drillable shoulder region 72 which is readily drilled via drill bit 64 when drill bit 64 is rotating. This facilitates drilling of a second borehole by drilling through the upper guide member 58 and moving the drill bit 64 and drill string 62 down through outer housing 50 externally of guide tubing 66. During drilling of the second borehole, the rotating drill bit 64 is able to drill through the drillable material of bullnose 52 before entering seafloor/formation 36 and drilling down into the subterranean formation. It should be noted that during drilling of the first borehole, the drill bit 64 may be rotated once it is moved into guide tubing 66 so as to drill through the bullnose 52 before entering the seafloor/formation 36 and drilling down into the subterranean formation.

Figure 4:
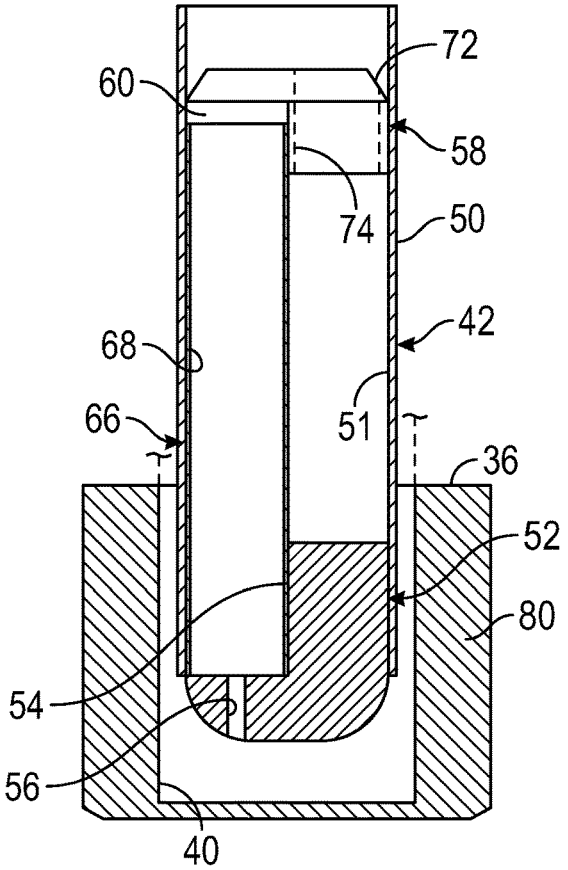
FIG. 4 is an illustration of another example of conductor sharing offset shoe system, according to an embodiment of the disclosure.

Referring generally to FIG. 4, another embodiment of conductor sharing offset shoe system 42 is illustrated. In this example, many of the components are similar or the same to those described with reference to the embodiment illustrated in FIG. 3. However, the upper guide member 58 is constructed without sloped surface 70.

If drill string 62 is a smart drill string or other type of controllable drill string, the drilling operations may be readily conducted without sloped surface 70. In this type of application, the upper guide member 58 may be formed with guide opening 60 and the solid, drillable shoulder 72 which is drilled out during the drilling operation forming the second borehole. However, the upper guide member 58 also may be formed with a second guide opening 74 to enable passage of the drill bit 64.

Figure 5:
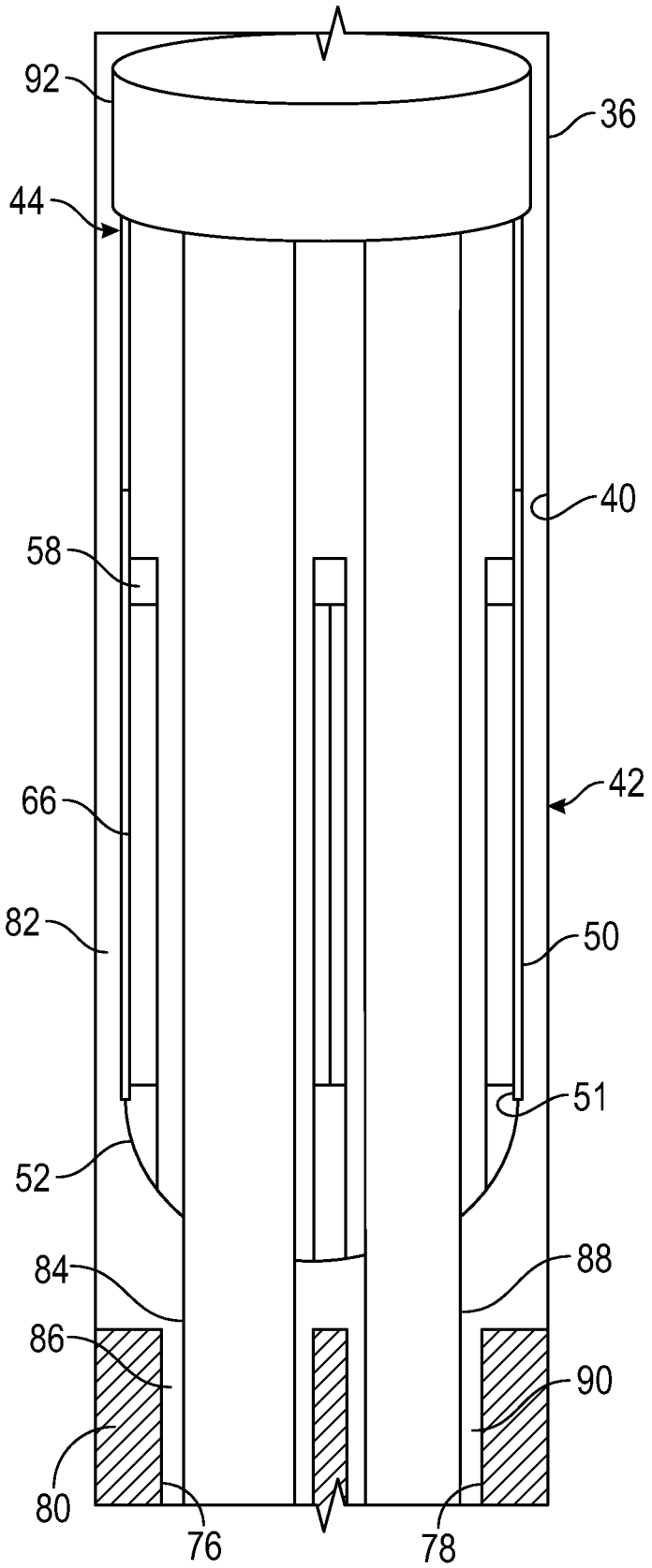
FIG. 5 is an illustration of an example of a pair of boreholes drilled and cased by utilizing the conductor sharing offset shoe system, according to an embodiment of the disclosure.

Before drilling a first borehole 76 and a second borehole 78, a conductor cementing operation may be performed as further illustrated in FIG. 5. The conductor cementing operation may be performed by delivering cement down through guide tubing 66, through passage 56, and into the annulus between outer housing 50 and a surrounding seabed/formation material 80 to thus form a cemented region 82. To the extent the conductor 44 extends into cavity 40, the cement is driven into the region between seabed/formation material 80 and the exterior of conductor 44 to set the conductor 44.

Once the CSOS 42 and conductor 44 are cemented into place, the drill string 62 may be moved down into engagement with upper guide member 58. The upper guide member 58 guides the drill bit 64 through guide opening 60 and into the interior passage 68 of guide tubing 66. The drill bit 64 is then rotated as it is moved into contact with the drillable material of bullnose 52 and is continually operated to form the first borehole 76.

Subsequently, a casing 84 may be moved down through the conductor 44, through CSOS 42, e.g. through guide tubing 66, and into the first borehole 76. Then, a cementing operation is performed by delivering cement down through the interior of casing 84 and up through a surrounding annulus to form a cemented region 86.

At this stage, the second borehole 78 may be drilled by moving the drill string 62 down into engagement with upper guide member 58. In some operational embodiments, the guide tubing 66 may be temporarily plugged or blocked to facilitate drilling of the second borehole 78. Regardless, the drill bit 64 is rotated as it is moved against drillable shoulder 72 so as to drill through the upper guide member 58. Once the drill bit 64 drills through guide member 58, the drill string 62 is guided down through the interior conductor passage 46 between the exterior of guide tubing 66 and the outer housing 50. The drill bit 64 is continually operated to drill down through bullnose 52 and into the formation to thus form the second borehole 78.

Subsequently, a second borehole casing 88 may be moved down through the CSOS 42 and into the second borehole 78. An additional cementing operation is then performed by delivering cement down through the interior of casing 88 and up through a surrounding annulus to form a cemented region 90. It should be noted that in some embodiments the cementing and drilling operations may be facilitated by installing a low pressure conductor sharing housing 92 on top of the conductor 44.

The properly oriented conductor sharing offset shoe system 42 ensures that the drill string 62 is held in position during drilling of the first borehole 76 and the second borehole 78. The proper positioning helps avoid borehole collision during drilling of the boreholes 76, 78. By initially orienting the conductor sharing offset shoe system 42 in a desired directional orientation, collisions with other adjacent boreholes also is avoided.

Figure 6:
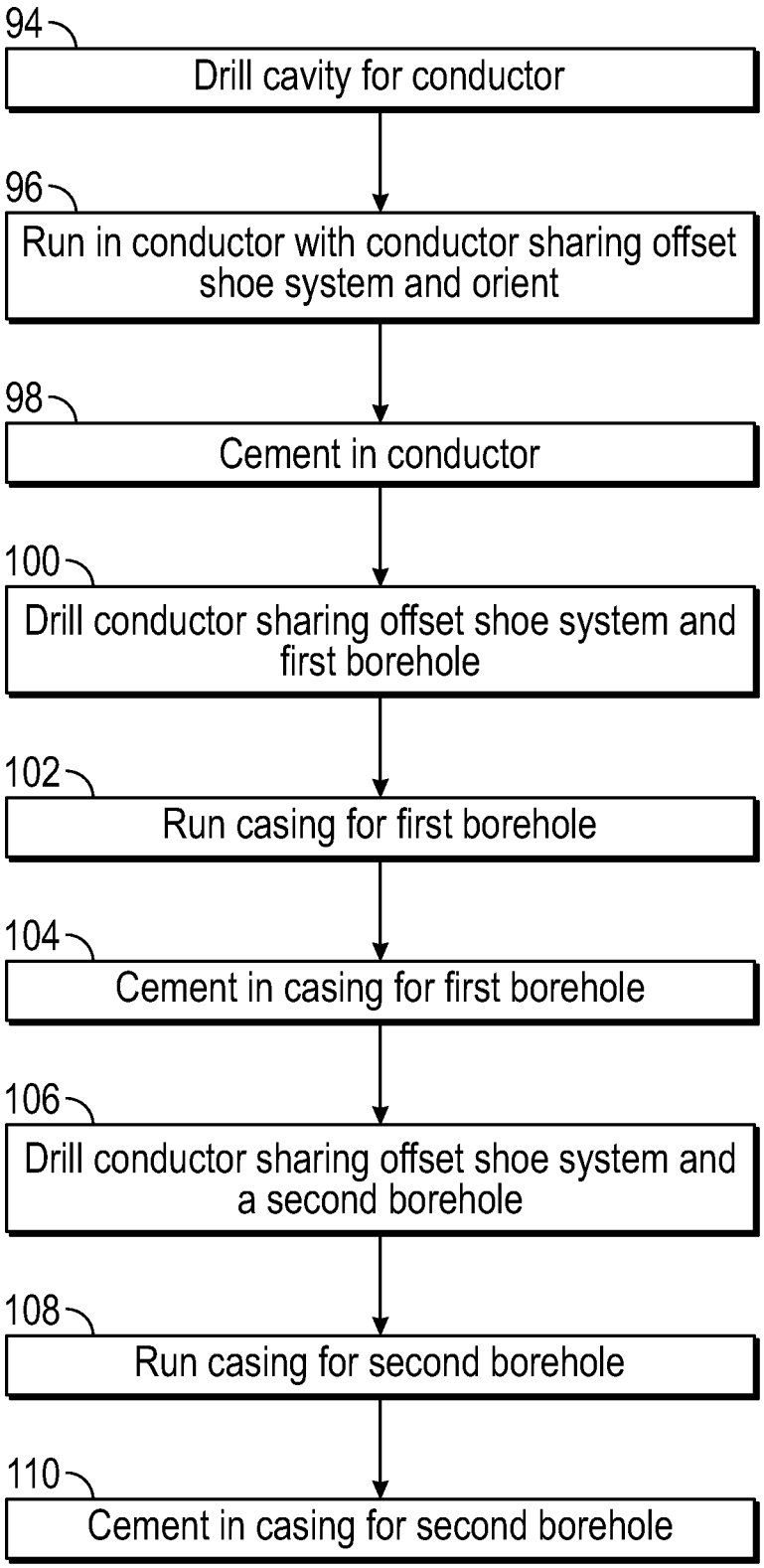
FIG. 6 is a flowchart illustrating an example of a methodology for utilizing the conductor sharing offset shoe system to control the drilling of a pair of boreholes through the conductor, according to an embodiment of the disclosure.

Referring generally to the flowchart of FIG. 6, an operational example is illustrated. According to this embodiment, conductor cavity 40 is initially drilled or otherwise formed as represented by block 94. The conductor 44 may then be run with the conductor sharing offset shoe system 42, as represented by block 96. In some embodiments, the conductor sharing offset shoe system 42 may be run as part of a casing string. The combined structure may be scribed to maintain a desired orientation. For example, the conductor 44 and CSOS 42 may be run in with the CSOS 42 maintaining orientation via a vertical scribe line.

Once the conductor 44 and the CSOS 42 are properly positioned in cavity 40, the conductor 44 and CSOS 42 may be cemented in, as represented by block 98. The conductor 44/CSOS 42 may be cemented in by delivering cement down through passage 56 and up into the annulus between CSOS 42 and the surrounding formation material 80. The cementing may be accomplished by a suitable stinger, smart string, or other suitable string deployed into or through the conductor sharing offset shoe system 42.

At this stage, the drill string 62 may be moved into position and the CSOS 42 may be drilled along with the first borehole 76, as represented by block 100. For some applications, the drilling operation is facilitated by first installing the lower pressure conductor sharing housing 92 to provide well control during drilling of the first borehole 76. As described above, the drilling operation involves moving drill bit 64 into engagement with the upper guide member 58. The sloped surface 70 is able to guide the drill string 62 into internal passage 68 of guide tubing 66. Then, the drill bit 64 is operated to drill through bullnose 52 and down into the formation material 80 to form first borehole 76.

Once first borehole 76 is formed, casing 84 may be run through the CSOS 42 to case the borehole 76, as represented by block 102. The casing 84 may be cemented in place, as represented by block 104. In some applications, the casing 84 may be constructed to hang off the low pressure conductor sharing housing 92 during the cementing operation.

Subsequently, the drill string 62 is moved into position to drill the other side of the conductor sharing offset shoe system 42 and to drill down into formation 80 to form second borehole 78, as represented by block 106. One approach to drilling the second borehole 78 is to initially cap the first drilled passage, although some drilling operations involve drilling the second borehole 78 without capping the first drilled passage. For example, the guide tubing 66 may be blocked or the drill bit 64 may be sized to prevent movement of the drill bit 64 into guide tubing 66 when the second borehole 78 is to be drilled. Regardless, the low pressure conductor sharing housing 92 may again be rigged up to facilitate drilling through the conductor sharing offset shoe system 42 and into formation material 80 to form the second borehole 78.

As described above, the second drilling procedure may involve drilling through shoulder 72 of upper guide member 58 and then guiding the drill string 62 down through CSOS 42 along the exterior of guide tubing 66. The drill bit 64 is operated to drill through the drillable material of bullnose 52 and into formation material 80 to form the second borehole 78. In some applications, the opening 74 may be used instead of shoulder 72 and drill string 62 may be in the form of a smart string or other suitable drill string which can controlled for movement into position at upper guide member 58 and then moved down along the exterior of guide tubing 66.

Once second borehole 78 is formed, casing 88 may be run through the CSOS 42 to case the borehole 78, as represented by block 108. The casing 88 may be cemented in place, as represented by block 110. In some applications, the casing 88 may be constructed to hang off the low pressure conductor sharing housing 92 during the second borehole cementing operation.

The structure of conductor sharing offset shoe system 42 allows for independent milling out of each side of the system 42 while, for example, rigged up to the low pressure conductor sharing housing 92. As a result, milling out of the entire shoe may be avoided. The conductor sharing offset shoe system 42 also enables the use of low-cost materials without special handling equipment or personnel. Depending on the parameters of a given operation, the conductor sharing offset shoe system 42 may be run with shoulder 72 at the second side or with a second opening 74 in conjunction with, for example, a smart string. The structure of the conductor sharing offset shoe system 42 ensures controlled separation of the drilling operations to provide a substantially reduced probability of borehole collision.

Depending on the specifics of a given use, the shape, size, and features of conductor 44 and conductor sharing offset shoe system 42 may be adjusted. For example, features of conductor sharing offset shoe system 42 may have various shapes and sizes to accommodate different types of drill strings and equipment. Similarly, the conductor 44, casings 84, 88, low pressure housing 92, and associated equipment may have many types of components and features to accommodate various drilling and cementing operations. Additionally, the conductor 44 and the conductor sharing offset shoe system 42 may be used in onshore and offshore applications, including offshore surface and offshore subsea applications.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for facilitating drilling, comprising:

a conductor having a conductor interior passage, the conductor being positioned at a subsea location in a cavity formed in a formation to facilitate drilling of a plurality of boreholes without collision of the boreholes; and a conductor sharing offset shoe system affixed to a lower end of the conductor, the conductor sharing offset shoe system comprising:

an outer housing;

a bullnose disposed at a lower end of the outer housing, the bullnose being formed of a drillable material;

an upper guide member disposed within the outer housing above the bullnose, the upper guide member having a guide opening sized to receive a drill bit therethrough during drilling of a first borehole; and a guide tubing extending along the interior of the outer housing from the guide opening into the bullnose, the guide tubing being oriented to direct drilling of the first borehole through the bullnose, the guide tubing being sized to receive the drill bit therethrough while also preserving sufficient space to accommodate movement of the drill string through the outer housing externally of the guide tubing during drilling of a second borehole through the bullnose.

2. The system as recited in claim 1, wherein the bullnose is formed of a drillable cement or composite material.

3. The system as recited in claim 1, wherein the upper guide member comprises a sloped surface oriented to guide the drill bit into the guide opening.

4. The system as recited in claim 1, wherein the upper guide member comprises a solid shoulder section which is drillable to enable passage of the drill string through the outer housing externally of the guide tubing during drilling of the second borehole.

5. The system as recited in claim 1, wherein the guide tubing is formed of a metal material.

6. The system as recited in claim 1, further comprising a wellhead mounted to the conductor.

7. The system as recited in claim 1, wherein the conductor sharing offset shoe system is rotationally oriented in the cavity to directionally orient the plurality of boreholes.

8. The system as recited in claim 1, wherein the conductor is cemented in the cavity.

9. The system as recited in claim 1, wherein casing is run through the conductor sharing offset shoe system for each of the first borehole and a second borehole after drilling of the first borehole and the second borehole.

10. A method, comprising:

positioning a conductor to facilitate drilling of a first borehole and a second borehole;

providing a conductor sharing offset shoe system with an outer housing, a bullnose disposed at a lower end of the outer housing; an upper guide member disposed in the outer housing above the bullnose; and a guide tubing extending between the bullnose and the upper guide member;

connecting the conductor sharing offset shoe system to a lower end of the conductor at a desired orientation;

moving the conductor sharing offset shoe and the conductor to a subsea location;

drilling the first borehole by moving a drill string through the guide tubing and through the bullnose; and subsequently drilling the second borehole by moving the drill string through the interior of the outer housing externally of the guide tubing and through the bullnose.

11. The method as recited in claim 10, further comprising using a sloped surface of the upper guide member to guide the drill string into the guide tubing for drilling of the first borehole.

12. The method as recited in claim 10, wherein positioning the conductor comprises forming a cavity in a formation and cementing the conductor into position in the cavity.

13. The method as recited in claim 10, further comprising forming the bullnose from a drillable material.

14. The method as recited in claim 10, further comprising placing casing in the first borehole and the second borehole.

15. The method as recited in claim 14, further comprising cementing the casing in the first borehole and the second borehole.

16. The method as recited in claim 10, further comprising forming the upper guide member from a drillable material.

17. A method, comprising:

constructing a conductor sharing offset shoe system with an outer housing, a bullnose, an upper guide member, and a guide tubing extending between the bullnose and the upper guide member;

positioning the conductor sharing offset shoe system at a lower end of a conductor;

locating the conductor sharing offset shoe system in a cavity formed in a formation;

using the guide tubing to guide a drill string through the bullnose during drilling of a first borehole at a desired location in a formation; and subsequently using space between the guide tubing and the outer housing to guide the drill string through the bullnose during drilling of a second borehole at a second desired location in the formation.

18. The method as recited in claim 17, further comprising drilling through the bullnose when drilling the first borehole and the second borehole.

19. The method as recited in claim 17, further comprising using a sloped surface of the upper guide member to guide a drill string into the guide tubing for drilling of the first borehole.

20. The method as recited in claim 17, further comprising directionally orienting the conductor sharing offset shoe system.

* * * * *